US006062346A

United States Patent [19]

Friedli et al.

[11] Patent Number: 6,062,346

[45] **Date of Patent: *May 16, 2000**

[54] CALL REGISTER AND INDICATING EQUIPMENT ARRANGED ON FLOORS FOR ELEVATORS

[75] Inventors: Paul Friedli, Remetschwil; Ernst Woschitz, Lucerne, both of Switzerland

[73] Assignee: Inventio AG, Hergiswil, Switzerland

[ * ] Notice: This patent issued on a continued prosecution application filed under 37 CFR 1.53(d), and is subject to the twenty year patent term provisions of 35 U.S.C. 154(a)(2).

[21] Appl. No.: 09/034,489

[22] Filed: Mar. 4, 1998

[30] Foreign Application Priority Data

Mar. 4, 1997 [EP] European Pat. Off. ..... 97810120

[51] Int. Cl.[7] ..... B66B 3/00

[52] U.S. Cl. ..... 187/395; 187/396

[58] Field of Search ..... 187/395, 396, 187/399; D10/108

[56] References Cited

U.S. PATENT DOCUMENTS

| | | | |
|---|---|---|---|
| D. 253,940 | 1/1980 | Bedel | D10/108 |
| D. 283,687 | 5/1986 | Walser | D10/108 |
| D. 339,543 | 9/1993 | Martin | D10/108 |
| 4,555,000 | 11/1985 | Umeda | 187/29 B |
| 4,871,992 | 10/1989 | Peterson | 340/407 |
| 4,915,197 | 4/1990 | Schroder | 187/137 |
| 4,972,926 | 11/1990 | Tsuji et al. | 187/137 |
| 5,300,728 | 4/1994 | Kostka et al. | 187/121 |
| 5,821,479 | 10/1998 | Kondo et al. | 187/395 |

FOREIGN PATENT DOCUMENTS

| | | | |
|---|---|---|---|
| 2-123081 | 5/1990 | Japan | 187/395 |
| 3-147685 | 6/1991 | Japan | 187/395 |
| 2 241 090 | 8/1991 | United Kingdom . | |
| WO 92/10421 | 6/1992 | WIPO | 187/395 |

OTHER PUBLICATIONS

Entrada, Simply Braillient, Oct. 1996, The Elevator World Source 1996–1997 p. 215, USA.

*Primary Examiner*—Jonathan Salata
*Attorney, Agent, or Firm*—MacMillan, Sobanski & Todd, LLC

[57] ABSTRACT

Call register and indicating equipment for elevators for the input of destination calls includes a call register and indicating device (1) having a key (2) for inputting a destination call for each selected one of a plurality of floors (F0, F1, F2, F3, F4). Arranged near the keys (2) are designation fields (3) that can be provided with written characters of an associated firm and/or symbols. After input of the desired floor call, the assigned elevator and its position are made known immediately on a display (4). By this call register and indicating equipment, all information necessary for finding the desired destination of travel the and the correct elevator are made available to the passenger at the point of input.

8 Claims, 1 Drawing Sheet

CALL REGISTER AND INDICATING EQUIPMENT ARRANGED ON FLOORS FOR ELEVATORS

BACKGROUND OF THE INVENTION

The present invention relates a hall call register and indicating device for an elevator arranged at least on one floor of a building served by the elevator.

There is shown in the U.S. Pat. No. 4,555,000 devices arranged on floors for the input of destination calls. In these devices the input of the calls takes place by means of direct destination keys on hall operation boards, where the key for the floor at which the passenger is located at that instant is missing in each case. After input of a call, a lamp arranged on the operation board lights up for confirmation. Subsequently the call is assigned to a car.

In the above-described device, the passenger is not advised directly at the call input location about the assigned car. This can, especially if many passengers are waiting on the same floor, lead to delays and jams in front of the elevator doors and strongly jeopardize the efficiency of the elevator installation. Furthermore, only the floor numbers are indicated on the devices for the input of the destination calls. This can be disadvantageous, if the passenger only knows his/her destination, for instance the garage in a department store or the name of a firm, but not the corresponding floor number.

SUMMARY OF THE INVENTION

The present invention concerns call register and indicating equipment adapted to be arranged on floors of a building for the input of destination calls for elevators serving the floors and for the indication of an elevator assigned to each of the destination calls. The equipment includes a call register and indicating device having at least one key for inputting destination calls to an elevator control, the key being provided with a number of a corresponding one of the floors, a designation field adjacent the key having an explanation associated with the corresponding floor and a display for indicating information associated with an inputted destination call.

The invention is based on the problem of providing call register and indicating equipment arranged on the floor levels and indicating devices for elevators of the type named above, which does not exhibit the disadvantages mentioned earlier and makes available to the passenger directly at the place of input all the information for finding the desired destination and the correct elevator to do so.

The advantages attained by the present invention are that at least a call register and indicating device is arranged on each floor, which enables the passenger in a simple manner, to find the correct destination and the appropriate elevator and relieve him/her of unnecessary information.

Through the device according to the present invention, it is possible to realize further advantageous constructions and improvements of call registers and indicating devices for elevators arranged on the floors. By installing only certain floor keys it is possible to guide the passenger to certain floors, such as for example from the garage in a basement, to the entrance of an exhibition, or the reception desk in a hotel or office.

BRIEF DESCRIPTION OF THE DRAWINGS

The above, as well as other advantages of the present invention, will become readily apparent to those skilled in the art from the following detailed description of a preferred embodiment when considered in the light of the accompanying drawings in which.

DESCRIPTION OF THE PREFERRED EMBODIMENT

Figure 1:
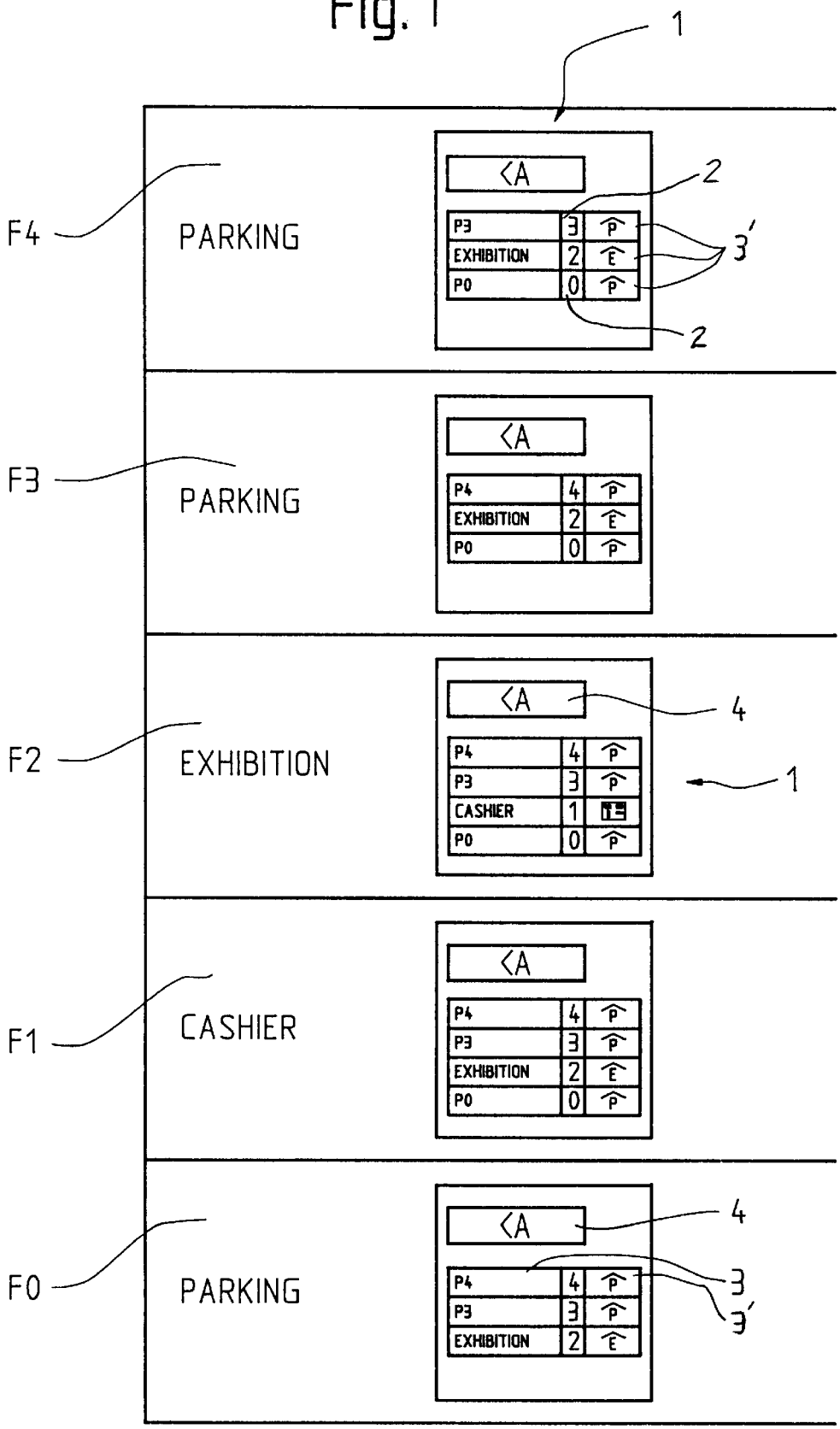
FIG. 1 is a schematic representation of call register and indicating equipment according to the present invention installed in a five-story building.

FIG. 1 is a schematic representation of elevator hall call register and indication equipment including a plurality of call register and indicating devices 1 for elevators in a five-story building. These call register and indicating devices 1 are arranged on a plurality of floors F0, F1, F2, F3, F4 of the building adjacent the elevator doors as is customary for destination call registering controls. The control of the elevator can, for instance, be carried out as described in the European published patent application EP 0 308 590 that shows a group control for elevators with instant assignment of destination calls.

The elevator can be called by actuating buttons or keys 2 provided on each of the call register and indicating devices 1. The keys 2 are used to select the destination floors F0 through F4. On one side of the keys 2 there are provided designation fields or indicating spaces 3, which spaces can have the logo (or name) of a company, and on the other side of the keys there can be provided a symbol or pictogram of the destination in designation fields or indicating spaces 3'. It is likewise possible to arrange the indicating spaces 3 with both types of explanation of the destination on one side or the other of the key 2. As a further possibility, the inscription on the indicating space 3 can also be formed in Braille. The keys 2 also can be provided with simple figures corresponding to the floors such as the floor numbers "2", "3" and "4" shown on the keys at the floor F0.

The call register and indicating devices 1 are furthermore equipped with a display 4 on which the assigned elevator and its location (or position) relative to the display is immediately indicated after entering the destination floor. As shown in the FIG. 1, an elevator A (not shown) on the left side (arrow towards the left) of the device 1 is the information indicated. In this way the passenger notices with one glance all the information necessary for his/her destination.

The present invention is especially useful in stores or merchandise warehouses, hotels or museums. In the FIG. 1, for example, there is shown a merchandise warehouse having the Parking floors F0, F3 and F4 for parking vehicles of customers. The showing of the merchandise is located on the Cashier floor F1 and the Exhibition floor F2. The customers start viewing the merchandise on the floor F2 and move to the floor F1 where the cashier is located. In order to direct the customer movement from the Parking floors F0, F3 and F4 directly to the Exhibition floor, each call register and indicating device 1 at the Parking floors is provided with a key 2 for the Exhibition floor F2, but is not provided with a key for the Cashier floor F1. Each call register and indicating device 1 at the Parking floors also is provided with a key 2 for each of the other two Parking floors in case the customer takes the elevator to the wrong Parking floor. The customer can enter a destination call for another Parking floor from the wrong Parking floor without an unnecessary journey back to the Exhibition floor F2.

The call register and indicating device 1 located at the Exhibition floor F2 includes the keys 2 for the three Parking floors F0, F3 and F4 to permit a customer to return directly to the Parking floors in case he or she has forgotten something in the vehicle. There also is provided the key 2 for the Cashier floor F1 that can be used to go directly to the Cashier floor for special purposes without having to walk through the whole showing. For example, customers may go directly to the cashier to ask questions or look for lost family members.

At the end of the exhibition, it is desirable to be able to reach all of the Parking floors and the Exhibition floor. Therefore, the call register and indicating device 1 located at the Cashier floor F1 includes the keys 2 for the three Parking floors F0, F3 and F4 to permit a customer to return directly to the Parking floors and the key 2 for the Exhibition floor F2.

Generally, each of the call register and indicating devices 1 is equipped so that with the installation of selected ones of the keys 2 only certain floors can be reached. Thus, visitors can be directed automatically to the beginning of an exhibition or showing to cause a one-way flow of traffic without annoying counter-traffic; or in the case of several parking floors, one or more of the floors can be omitted. Through the absence of unnecessary keys or buttons 2, only selected floors can be reached by the elevator user and thereby the elevator service becomes more efficient and wrong destination calls are eliminated.

The call register and indicating equipment shown in the FIG. 1 can be used, for example, in hotels so that the floors with guest rooms can be reached only from the lobby, and the floors with a restaurant or other public places can be reached from the floors with the guest rooms but not other guest room floors.

In summary, the call register and indicating equipment adapted to be arranged on floors of a building for the input of destination calls for elevators serving the floors F0, F1, F2, F3, F4 and for the indication of an elevator assigned to each of the destination calls comprises: the call register and indicating device 1 having at least the one key 2 for inputting destination calls to the elevator control, the key being provided with the number of the corresponding one of the floors; the designation field 3 adjacent the key having an explanation associated with the corresponding floor; and the display 4 for indicating information associated with an inputted destination call.

In accordance with the provisions of the patent statutes, the present invention has been described in what is considered to represent its preferred embodiment. However, it should be noted that the invention can be practiced otherwise than as specifically illustrated and described without departing from its spirit or scope.

What is claimed is:

1. Call register and indicating equipment for a plurality of floors in a building for the input of destination calls to elevator cars serving the plurality of floors to control traffic flow among the floors comprising:

a plurality of call register and indicating devices, each said call register and indicating device adapted to be located at an associated one of a plurality of floors to be served by elevator cars of an elevator system;

each said call register and indicating device including at least one destination call input key for generating a destination call representing an associated one of the plurality of floors to which travel is intended, each said destination call input key having an associated designation field positioned adjacent thereto with a constantly visible fixed explanation related to the floor associated with said destination call input key;

a display adjacent each of said call register and indicating devices for indicating an elevator car assigned in response to a destination call generated by actuation of said one destination call input key of said adjacent call register and indicating device; and at least one of said call register and indicating devices being provided with a number of said destination call input keys less than the plurality of floors whereby travel from the floor associated with said at least one call register and indicating device to another one of the plurality of floors is restricted and traffic flow among the plurality of floors is controlled.

2. The call register and indicating equipment according to claim 1 wherein said displays indicate a position of the assigned elevator relative to said displays.

3. The call register and indicating equipment according to claim 1 wherein each said designation field is located at one side of said associated input key and including another designation field located at another side of said associated input key.

4. The call register and indicating equipment according to claim 1 wherein said designation field is provided with written characters as the explanation.

5. The call register and indicating equipment according to claim 4 wherein said written characters on said designation field are written in addition in Braille.

6. The call register and indicating equipment according to claim 1 wherein said designation field is provided with at least one symbol as the explanation.

7. Call register and indicating equipment for a plurality of floors in a building for the input of destination calls to elevator cars serving the plurality of floors to control traffic flow among the floors comprising:

a plurality of call register and indicating devices, each said call register and indicating device adapted to be located at an associated one of a plurality of floors to be served by elevators of an elevator system;

at least one of said call register and indicating devices including a separate destination call input key for each of the floors except the floor associated with said one call register and indicating device, each said destination call input key generating upon actuation a destination call representing an associated one of the plurality of floors to which travel is intended; and at least another one of said call register and indicating devices including a separate destination call input key for each of the floors except the floor associated with said one call register and indicating device and at least another one of the floors, each said destination call input key generating upon actuation a destination call representing an associated one of the plurality of floors to which travel is intended whereby travel from the floor associated with said another one call register and indicating device is restricted and traffic flow among the plurality of floors is controlled.

8. The call register and indicating equipment according to claim 7 including a display adjacent each of said call register and indicating devices for indicating an elevator car assigned in response to a destination call generated by actuation of one of said destination call input keys of said adjacent call register and indicating device, said displays indicating a position of the assigned elevator relative to said displays.

* * * * *